US007658240B2

(12) United States Patent
Anderson

(10) Patent No.: US 7,658,240 B2
(45) Date of Patent: Feb. 9, 2010

(54) METHODS AND APPARATUS FOR FORMING HOLE IN GROUND

(76) Inventor: Paul L. Anderson, 5510 Hwy. 114, SW., Alexandria, MN (US) 56308

( * ) Notice: Subject to any disclaimer, the term of this patent is extended or adjusted under 35 U.S.C. 154(b) by 133 days.

(21) Appl. No.: 12/045,945

(22) Filed: Mar. 11, 2008

(65) Prior Publication Data

US 2008/0223615 A1 Sep. 18, 2008

Related U.S. Application Data

(60) Provisional application No. 60/894,279, filed on Mar. 12, 2007.

(51) Int. Cl.
*E21B 7/26* (2006.01)

(52) U.S. Cl. ..... 175/19; 175/23; 173/184

(58) Field of Classification Search ..... 175/19, 175/22, 23; 173/184, 187, 189; 405/259.1, 405/232

See application file for complete search history.

(56) References Cited

U.S. PATENT DOCUMENTS 3,710,876 A 1/1973 Christensen
3,746,104 A 7/1973 McIntosh et al.
4,193,459 A 3/1980 Engstrom
4,246,974 A 1/1981 Rothrock
4,682,659 A 7/1987 Holopainen
4,836,294 A 6/1989 Bencriscutto
5,111,888 A 5/1992 Wimmer
5,556,217 A 9/1996 Deyo et al.
5,868,211 A 2/1999 Bohn
6,764,139 B1 7/2004 Wortman
6,889,777 B2 5/2005 Boley et al.
7,152,694 B2 12/2006 Dennis
2003/0047359 A1 3/2003 Shupe

*Primary Examiner*—Giovanna C Wright
(74) *Attorney, Agent, or Firm*—Alan Kamrath; Kamrath & Associates PA

(57) ABSTRACT

An apparatus for forming a hole in ground (10) includes a mounting plate (60) mounted to a loader (80). A probe (11) is coupled with the mounting plate (60). Two arms (32) extend radially outward from a vertical axis and from a periphery of the probe (11). The apparatus further includes two cylinders (40) each having an upper end (42) coupled to the mounting plate (60) and a lower end (44) coupled to one of the arms (32). The probe (11) is driven into the ground along the vertical axis by movement of the mounting plate (60) by the loader (80), and an upper portion of the probe (11) is simultaneously wobbled about two axes that are perpendicular to each other and to the vertical axis by moving at least one of the cylinders (40). The probe (11) is then moved out of the ground to leave a hole in the ground.

20 Claims, 5 Drawing Sheets

METHODS AND APPARATUS FOR FORMING HOLE IN GROUND

CROSS REFERENCE TO RELATED APPLICATION

The present application claims benefit of U.S. Application No. 60/894,279 filed on Mar. 12, 2007.

BACKGROUND

The present invention relates to methods and apparatus for forming a hole in ground and, more particularly, to methods and apparatus for moving a probe attached to a loader or the like for rapidly forming a hole in the ground.

Postholes for fence posts, flag poles or the like can be formed with the use of an auger. Digging a hole in the ground with the auger, inserting a post into the hole, and filling dirt and tamping the dirt around the post are laborious and very time consuming. Another approach is to drive posts into the ground by a pile driver, but this is typically limited to strong posts of a limited cross sectional size. Another approach utilizes a tapered bar attached to a bucket of a loader and driven into the ground to dig a hole. A post is then inserted into the hole. However, such approach has deficiencies in forming the hole as it relies upon the mass of the loader, and there is considerable friction between the tapered bar and the ground when making the hole in the ground.

Thus, a need exists for methods and apparatus that can rapidly form a hole in the ground, which overcome the deficiencies of the prior approaches, and that allow easy placement of a post in the hole.

SUMMARY

The present invention solves this need and other problems in the field of forming holes in the ground for posts and the like by providing, in a first aspect, novel methods and apparatus for rapidly forming a hole in the ground.

In another aspect of the present invention, such novel methods and apparatus can insert a tube or sleeve and leave the tube or sleeve in the hole in the ground.

An apparatus according to the preferred teachings of the present invention includes, in a preferred form, a mounting plate adapted to be mounted to a bucket of a loader. A probe is coupled with the mounting plate and includes a bottom end spaced from the mounting plate along a vertical axis perpendicular to the ground. The bottom end of the probe is adapted for digging a hole in the ground. First and second arms extend radially outward from the vertical axis and from a periphery of the probe spaced from the bottom end of the probe. The arms are spaced from each other in a periphery direction of the probe not greater than 180° and, in the most preferred form, in the order of 90°. The apparatus further includes first and second cylinders each having an upper end coupled to the mounting plate and a lower end coupled to one of the arms. Each cylinder is movable between an extended position and a retracted position. The probe is movable along the vertical axis into the ground by movement of the mounting plate by the loader to move the mounting plate along the vertical axis and simultaneously moving at least one of the cylinders. The probe is movable out of the ground along the vertical axis to leave a hole in the ground.

In the most preferred form, the bottom end of the probe is a pointed end. The probe further includes an upper section spaced from the bottom end along the vertical axis and fixed to the mounting plate, a lower section having the bottom end, and an intermediate section between the upper and lower sections. The intermediate section is coupled with each of the upper and lower sections by a universal joint. The cylinders extend generally parallel to and spaced from the vertical axis. The upper end of each cylinder is coupled to a sphere formed on an underside of a horizontal section of an L-shaped mounting plate by a ball joint. The lower end of each cylinder is coupled to a distal end of the one of the arms by a ball joint. The cylinders are drivable to move in the same direction along the vertical axis at the same rate or at different rates or to move in different directions along the vertical axis.

A method for forming a hole in ground according to the preferred teachings of the present invention includes, in a preferred example, driving a probe into ground along a vertical axis. The probe has a bottom, pointed end and an upper portion spaced from the bottom end along the vertical axis. While the probe is being driven into the ground, the upper portion of the probe is simultaneously wobbled about two axes perpendicular to each other and to the vertical axis. After the probe is driven into the ground, the probe is moved upward from the ground along the vertical axis, leaving a hole in the ground. A sleeve can be mounted around the probe before driving the probe into the ground, and the sleeve is left in the ground after moving the probe upward from the ground along the vertical axis.

In most preferred aspects, a weight can be mounted on an upper side of the horizontal section of the mounting plate to assist in digging the hole. Likewise, a vibrator can be mounted on the mounting plate to vibrate the mounting plate and the probe along the vertical axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
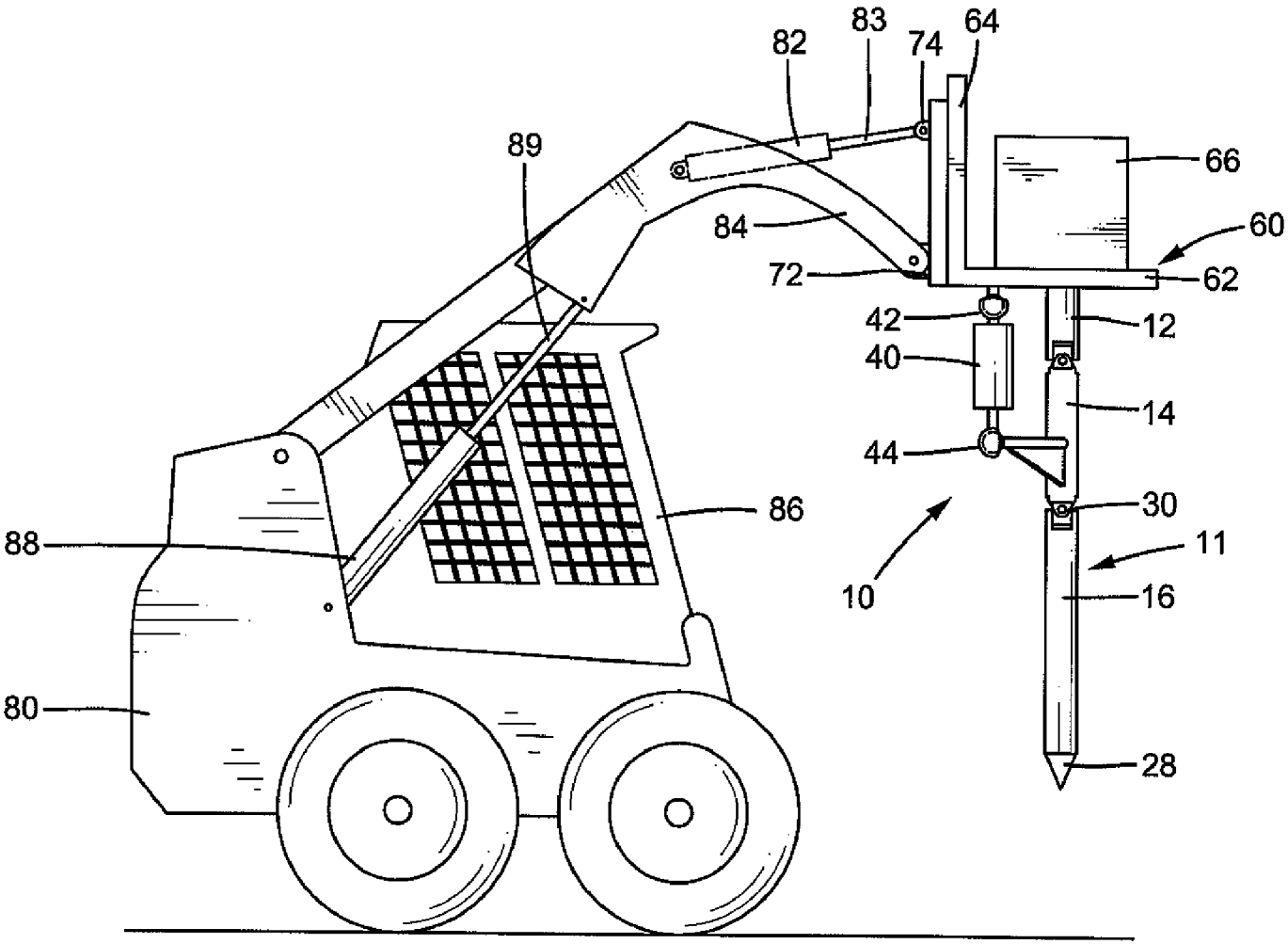
FIG. 1 shows a side elevational view of a loader with an apparatus according to the preferred teachings of the present invention.
Figure 2:
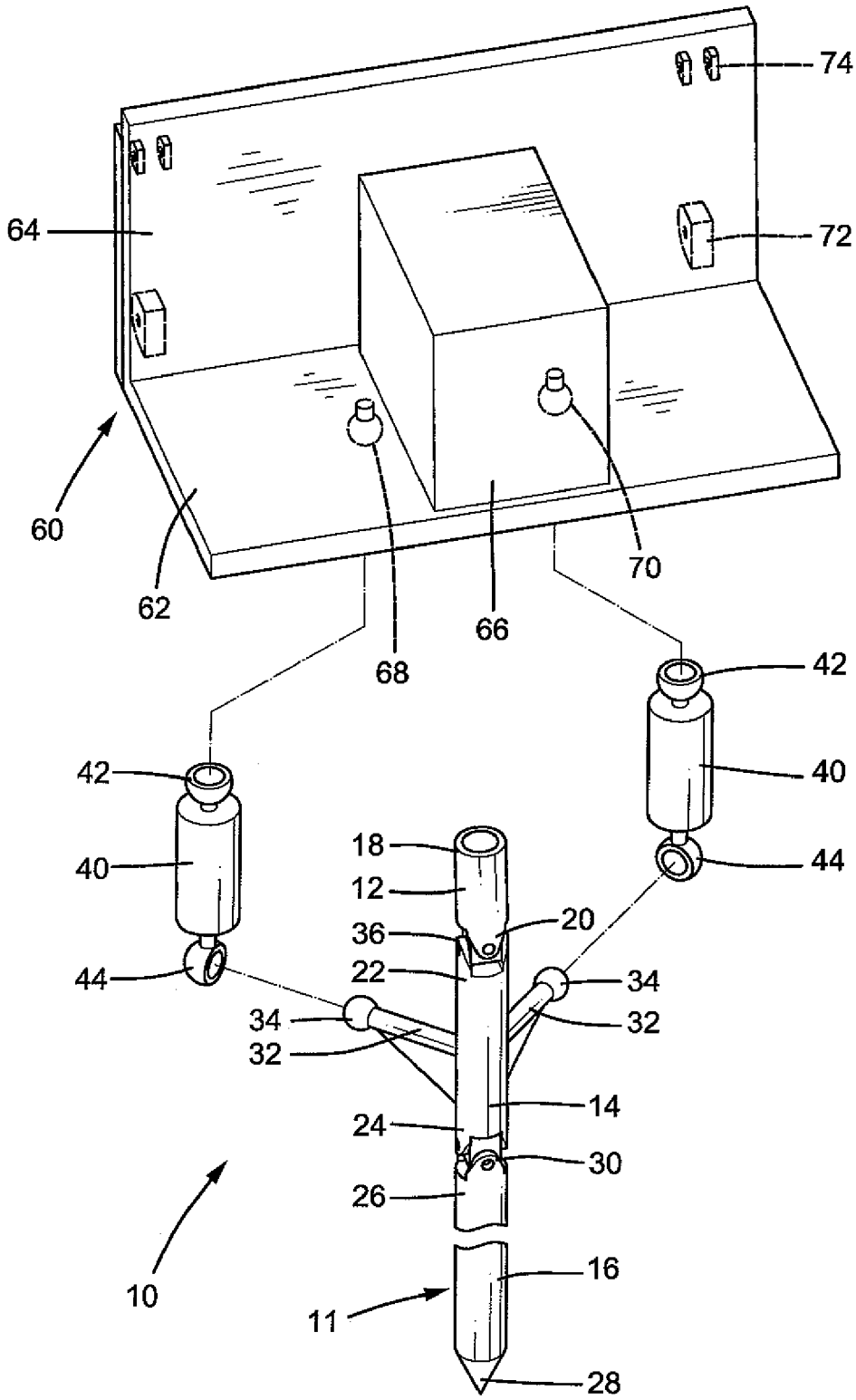
FIG. 2 shows an exploded perspective view of the apparatus of FIG. 1.
Figure 3:
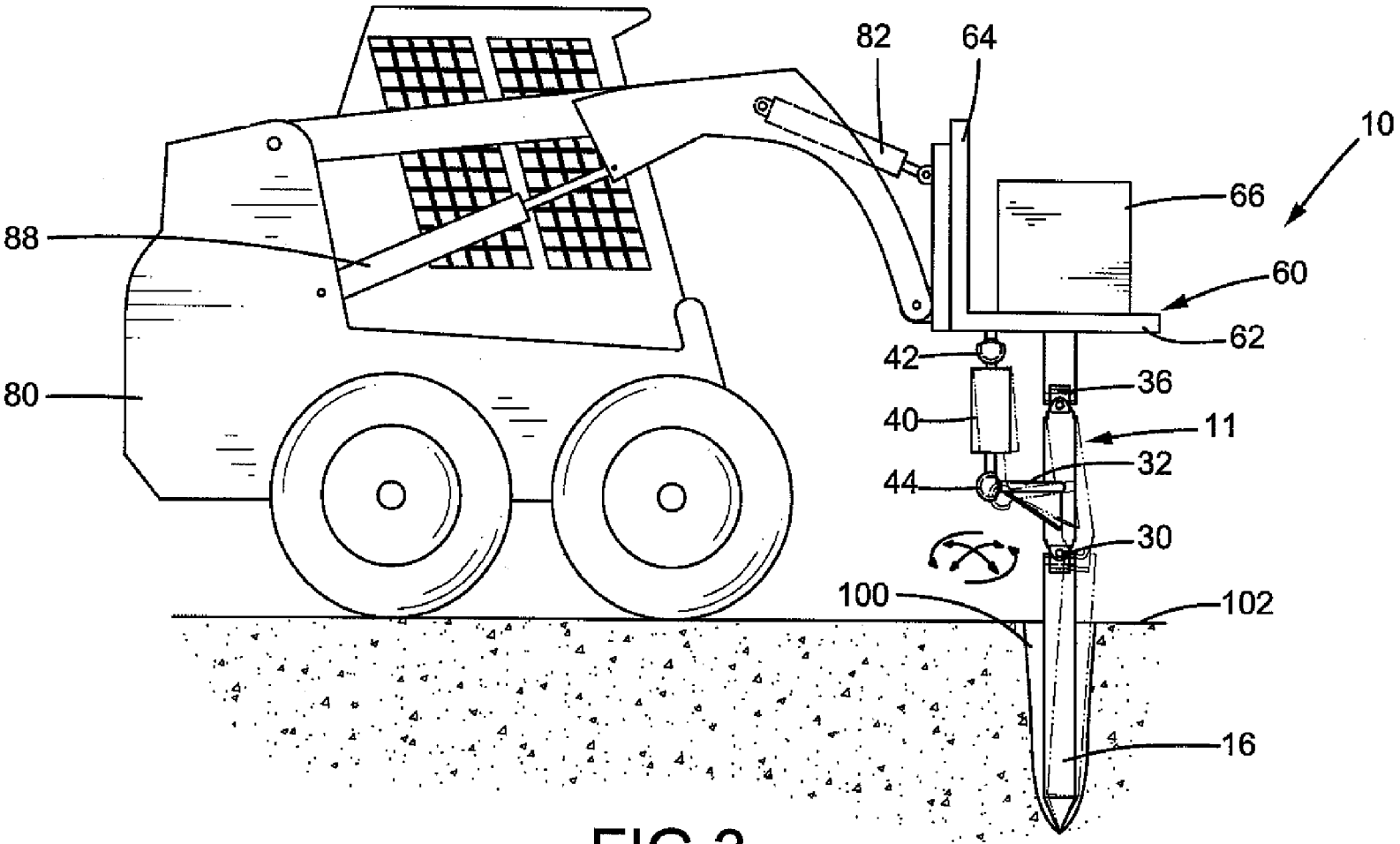
FIG. 3 is a side elevational view showing operation of the apparatus of FIG. 1.
Figure 4:
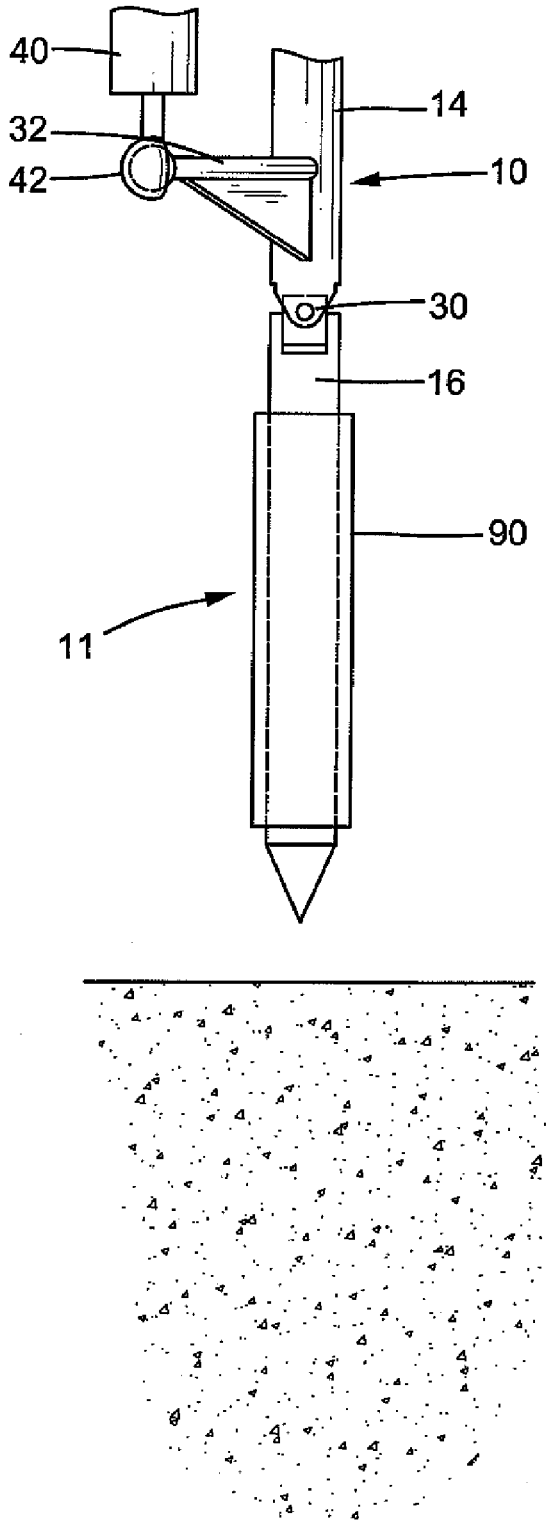
FIG. 4 is a partial, side elevational view showing use of a sleeve with the apparatus of FIG. 1 according to the preferred teachings of the present invention.
Figure 5:
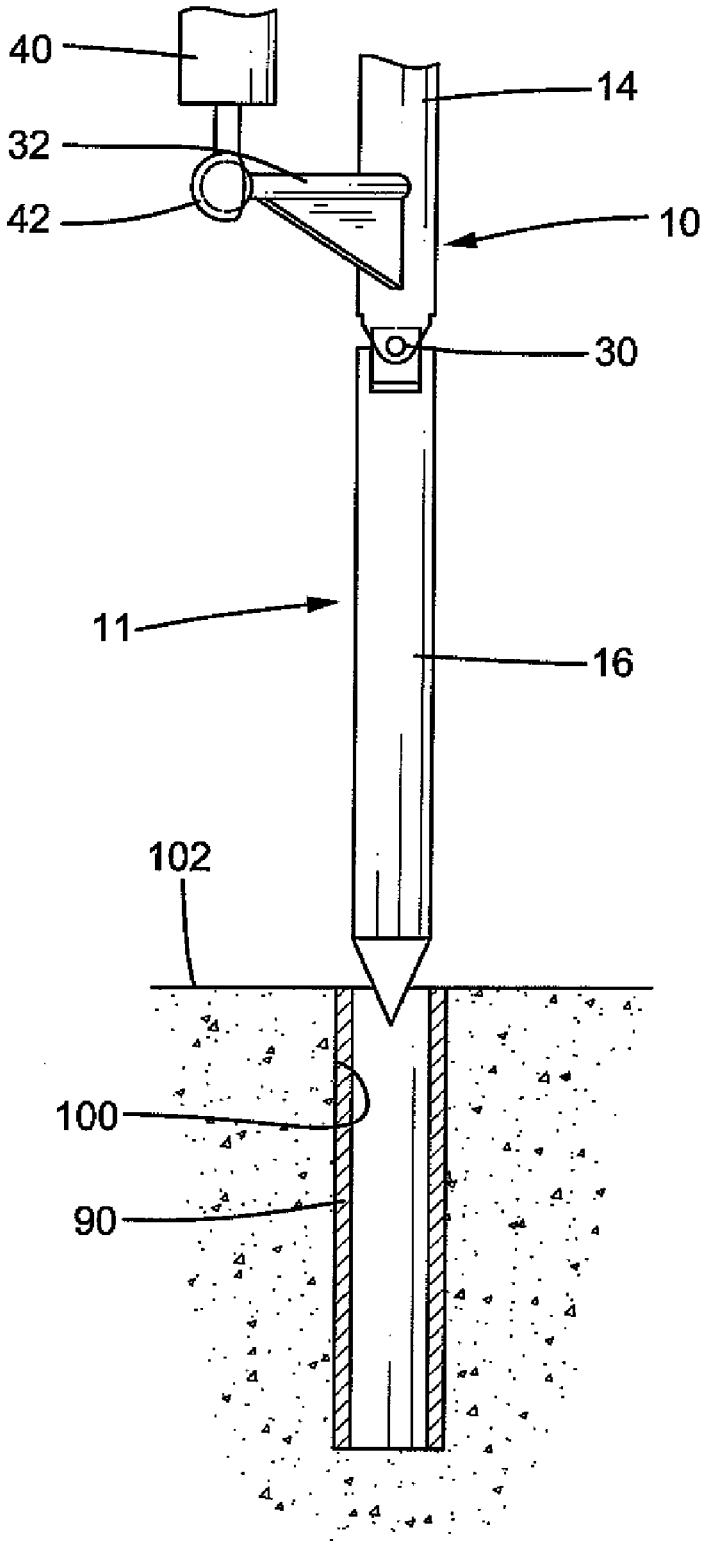
FIG. 5 is a partial, schematic view showing operation of the apparatus of FIG. 4.

All figures are drawn for ease of explanation of the basic teachings of the present invention only; the extensions of the figures with respect to number, position, relationship, and dimensions of the parts to form the preferred embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "upper", "lower", "bottom", "end", "side", "portion", "section", "horizontal", "vertical", "radial", "sideway", and similar terms are used herein, it should be understood that these terms have reference only to the structure shown in the drawings as it would appear to a person viewing the drawings and are utilized only to facilitate describing the illustrative embodiments.

DESCRIPTION OF THE PREFERRED EMBODIMENTS

An apparatus which can rapidly form a hole in the ground utilizing methods according to the preferred teachings of the present invention is shown in the drawings and generally designated 10. The apparatus 10 can be conveniently coupled to a mounting plate 60 such as a bucket of a loader 80. The loader 80 may be a skid steer loader, payloader, boom truck, crane or the like. In the preferred form shown, the mounting plate 60 attached to a skid steer loader is substantially L-shaped and includes a vertical section 64 and a horizontal section 62. Two spaced lugs 72 are provided on a lower portion of a rear side of vertical section 64 for pivotal connection with front ends of a pair of arms 84 of the loader 80. A rear end of each arm 84 is connected to a front end of a piston rod 89 of a hydraulic cylinder 88. Two pairs of ears 74 are provided on an upper portion of the rear side of the vertical section 64 for pivotal connection with front ends of piston rods 83 of a pair of hydraulic cylinders 82. These hydraulic cylinders 82 and 88 allow a driver in a cab 86 of the loader 80 to control movements of the mounting plate 60. Other arrangements for driving the mounting plate 60 would be within the skill of the art.

Generally, the apparatus 10 includes a probe 11 which may be tubular or solid and may be of any desired form, such as rectangular, square, round, oval, etc. in section. In the preferred form shown, the probe 11 is cylindrical and includes an upper section 12, a lower section 16, and an intermediate section 14 between the upper and lower sections 12 and 16. The upper section 12 includes an upper end 18 fixed to an underside of the horizontal section 62 and a lower end 20 coupled with an upper end 22 of the intermediate section 14 by a joint 36 such as a ball joint or universal joint. A lower end 24 of the intermediate section 14 is coupled with an upper end 26 of the lower section 16 by a joint 30 such as a ball joint or universal joint. In the most preferred shown, the upper and lower ends 22 and 24 of the intermediate section 14 are coupled with the upper and lower sections 12 and 16 by universal joints The universal joints can be of any desired form as conventional ones including but not limited to of a commercially available type.

The apparatus 10 further includes suitable provisions for moving the probe 11 relative to the mounting plate 60 utilizing methods according to the preferred teachings of the present invention. Specifically, in the form shown, two brackets or arms 32 extend radially outward from a periphery of the intermediate section 14 of the probe 11. The arms 32 are spaced from each other in a peripheral direction of the probe 11 by an angle not greater than 180°. In the most preferred form shown, the arms 32 are spaced from each other by 90° and each include a distal end 34 in the form of a sphere or the like.

Two hydraulic cylinders 40 are mounted between the horizontal section 62 and the arms 32. In the preferred form shown, each hydraulic cylinder 40 includes a lower end 44 coupled with one of the distal ends 34 of the arms 32 to provide a ball joint. Two spheres 68 and 70 or the like are formed on the underside of the horizontal section 62 of the mounting plate 60 and coupled with upper ends 42 of the hydraulic cylinders 40 to provide ball joints. The ball joints can be of any desired form as conventional ones including but not limited to of a commercially available type.

Now that the basic construction of the apparatus 10 according to the preferred teachings of the present invention has been set forth, a method of operation can be explained, and some of the advantages obtained thereby highlighted. After the loader 80 is moved into position and the mounting plate 60 is lifted, the mounting plate 60 is moved downward under control of the hydraulic cylinders 82 and 88 of the loader 80 to drive the probe 11 into the ground 102 so as to dig a hole 100 in the ground 102. Simultaneously, the probe 11 is moved sideways, back and forth, and/or around to push dirt aside so that there is little or even no friction between the probe 11 and the side of the hole 100 along the upper portion of the lower section 16. Particularly, the upper portion of the probe 11 wobbles about a first axis perpendicular to the vertical axis and a second axis perpendicular to the vertical axis and perpendicular to the first axis. It can be appreciated that the hydraulic cylinders 40 can be operated to obtain any type of orbital and back-and-forth motions of the probe 11 with control valves. Specifically, one of the hydraulic cylinders 40 may extend or retract while the other is stationary. Alternatively, the hydraulic cylinders 40 may extend or retract at the same rate or at different rates at the same time. It is noted that the bottom of the hole 100 becomes the pivot point when the upper portion of the probe 11 is moved back and forth and around. In an example, the upper portion of the probe 11 is moved sideways and then downward pressure is applied to the probe 11 by the loader 80. In another example, the upper portion of the probe 11 is moved sideways and at times somewhat circular. By moving the probe 11 in these ways, most effective deepening can occur when the probe 11 is in the center of the hole 100. This is because the downward pressure is completely applied to the bottom, pointed end 28 of the probe 11. It is noted that circular path of the probe 11 may have a smaller diameter than the maximum back and forth movement of the probe 11 and that the back and forth movement of the probe 11 may not be straight. Namely, the probe 11 may have any desired motion or path while or in between the downward pressure with the loader 80. Since the probe 11 "wobbles", the hole 100 in the ground 102 is larger than the probe 11 except at the bottom, pointed end 28 of the probe 11 such that friction with the probe 11 is minimized during use.

To provide the most effective way to deepen the hole 100, the motion at the upper portion or path of the probe 11 keeps passing through the center of the hole 100. By moving the upper portion of the probe 11 all around the sides of the hole 100 to force the dirt to the sides of the hole 100 and then moving the probe 11 to the center of the hole 100, there is little or no friction on the upper portion of the probe 11, for all the downward pressure gets focused on the bottom, pointed end 28 of the probe 11.

Furthermore, a weight or vibrator 66 can be mounted on the horizontal section 62 for performing or assisting in hole-digging operation of the probe 11. In a case a weight is used, the weight can be simply a large mass. In another case, a vibrator is used, with the vibrator being reversible so that in one mode of operation the vibrator helps the probe 11 to be driven into the ground 102 and in another mode of operation, the vibrator helps the probe 11 being removed from the hole 100 in the ground 102.

The hole 100 can be used for many purposes including but not limited to mount a post, pole, flag pole or the like. Specifically, a post or the like is inserted into the hole 100 in the ground 102, and dirt is filled around the post and in the hole 100 to firmly grip the post in the hole 100. The bottom of the post requires little or no tamping. Furthermore, the post can be mounted in the hole 100 without the power of the loader 80, for the hole 100 thus formed is large and deep enough.

One of the joints 30 and 36 may be omitted if the loader 80 can provide similar motion for the portion of the probe 11 above the ground 102 by nature of its design, such as a skid steer loader. In a case the probe 11 is not square in section, the joint 30 can be a ball joint. In another example, a tube or sleeve 90 may be manually mounted around the lower section 16 of the probe 11 and retained on the probe 11 by friction. The sleeve 90 includes an inner diameter for slidable receipt on the probe 11. During making of a hole 100 in the ground 102, the sleeve 90 moves together with the probe 11. After the hole 100 is made and dirt is filled around the sleeve 90 and in the hole 100 to firmly grip the sleeve 90 in the hole 100, the probe 11 is lifted upward from the ground 102 while the sleeve 90 remains in the hole 100. A post or the like can be then inserted into the sleeve 90. An advantage of using the sleeve 90 is that the post can be removed or replaced if desired (for example to replace a broken post).

The apparatus 10 according to the preferred teachings of the present invention allows rapid drilling of holes (faster than drilling a hole by an auger) and will slip by rocks or push the rocks to the side. Furthermore, the apparatus 10 according to the preferred teachings of the present invention makes a firmer setting for a pole or post, for the probe 11 pushes or packs dirt to the side of the hole 100. Furthermore, the hole 100 formed by the probe 11 according to the preferred teachings of the present invention is large enough and, thus, allows easy placing of a pole or post. Furthermore, the apparatus 10 according to the preferred teachings of the present invention requires less maintenance and less expensive equipment than conventional auger equipment. Furthermore, the apparatus 10 according to the preferred teachings of the present invention allows easy and accurate locating of the hole 100 by a laser beam. Further, when punching a hole 100 with the apparatus 10 according to the preferred teachings of the present invention, the probe size can be the exact size of the post so that the bottom of the post requires little or no tamping, and there is no messy pile of dirt that is apt to be produced with conventional auger equipment. Further, the apparatus 10 according to the preferred teachings of the present invention can insert a tube or sleeve 90 and leave the tube or sleeve 90 in the ground.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An apparatus for forming a hole in ground comprising, in combination:

a mounting plate adapted to be mounted to a bucket of a loader;

a probe coupled with the mounting plate, with the probe including a bottom end spaced from the mounting plate along a vertical axis perpendicular to the ground, with the bottom end of the probe being adapted for digging a hole in the ground, with the probe movable relative to the mounting plate about a first axis perpendicular to the vertical axis and a second axis perpendicular to the vertical axis and perpendicular to the first axis;

first and second arms extending radially outward from the vertical axis and from a periphery of the probe spaced from the bottom end of the probe, with the first and second arms being spaced from each other in a periphery direction of the probe not greater than 180°; and first and second cylinders each including an upper end coupled to the mounting plate, with the first cylinder further including a lower end coupled to the first arm, with the second cylinder further including a lower end coupled to the second arm, with each of the first and second cylinders being movable between an extended position and a retracted position, with the probe being movable along the vertical axis into the ground by movement of the mounting plate by the loader to move the mounting plate along the vertical axis and simultaneously moving at least one of the first and second cylinders, and with the probe being movable out of the ground along the vertical axis to form a hole in the ground.

2. The apparatus for forming the hole in the ground as claimed in claim 1, with the bottom end of the probe being a pointed end, with the probe further including an upper end spaced from the bottom end along the vertical axis, with the probe including an upper section having the upper end, a lower section having the bottom end, and an intermediate section between the upper and lower sections, with the intermediate section being coupled with the upper section by a universal joint, with the intermediate section being coupled with the lower section by a universal joint, with the upper end fixed to the mounting plate, and with the first and second arms extending from the intermediate section.

3. The apparatus for forming the hole in the ground as claimed in claim 2, with the upper end of each of the first and second cylinders interconnected to the mounting plate by a ball joint, with the lower end of the first cylinder coupled to a distal end of the first arm by a ball joint, and with the lower end of the second cylinder coupled to a distal end of the second arm by a ball joint.

4. The apparatus for forming the hole in the ground as claimed in claim 3, with the first and second arms being spaced from each other in the peripheral direction of the probe by 90°.

5. The apparatus for forming the hole in the ground as claimed in claim 4, with the first and second cylinders extending generally parallel to and spaced from the vertical axis.

6. The apparatus for forming the hole in the ground as claimed in claim 1, with the mounting plate being L-shaped and including a vertical section adapted to be coupled with a device for controlling movement of the mounting plate along the vertical axis, with the mounting plate further including a horizontal section having an underside, with two spheres being formed on the underside of the horizontal section, and with the upper end of each of the first and second cylinders being coupled to one of the spheres by a ball joint.

7. The apparatus for forming the hole in the ground as claimed in claim 6, with the horizontal section of the mounting plate further including an upper side opposite to the bottom side, with the apparatus further comprising, in combination: a weight mounted on the upper side of the horizontal section of the mounting plate, with the weight assisting in digging the hole.

8. The apparatus for forming the hole in the ground as claimed in claim 6, further comprising, in combination: a vibrator mounted on the mounting plate, with the vibrator vibrating the mounting plate and the probe along the vertical axis.

9. The apparatus for forming the hole in the ground as claimed in claim 1, with the first and second cylinders being drivable to move in the same direction along the vertical axis at the same rate or at different rates or to move in different directions along the vertical axis.

10. The apparatus for forming the hole in the ground as claimed in claim 1, with the first and second arms being spaced from each other in the peripheral direction of the probe by 90°.

11. The apparatus for forming the hole in the ground as claimed in claim 1, with the upper end of each of the first and second cylinders interconnected to the mounting plate by a ball joint, with the lower end of the first cylinder coupled to a distal end of the first arm by a ball joint, and with the lower end of the second cylinder coupled to a distal end of the second arm by a ball joint.

12. The apparatus for forming the hole in the ground as claimed in claim 11, with the first and second arms being spaced from each other in the peripheral direction of the probe by 90°.

13. A method for forming a hole in ground comprising:

driving a probe into ground along a vertical axis, with the probe having a bottom, pointed end and an upper portion spaced from the bottom end along the vertical axis;

while the probe is being driven into the ground, simultaneously wobbling the upper portion of the probe about a first axis perpendicular to the vertical axis and a second axis perpendicular to the vertical axis and perpendicular to the first axis; and after the probe is driven into the ground, moving the probe upward from the ground along the vertical axis, leaving a hole in the ground.

14. The method for forming the hole in the ground as claimed in claim 13, further comprising:

vibrating the probe along the vertical axis while driving the probe into the ground and wobbling the probe.

15. The method for forming the hole in the ground as claimed in claim 13, with driving the probe into ground along the vertical axis including moving a mounting plate of a loader downward, with the probe being mounted on the mounting plate, with wobbling the probe including moving two cylinders in a same direction at a same rate or at different rates or moving the two cylinders in different directions, with each of the two cylinders being movable between an extended position and a retracted position, with each of the two cylinders including an upper end interconnected to the mounting plate by a first universal joint and a lower end coupled to the probe by a second universal joint.

16. The method for forming the hole in the ground as claimed in claim 15, further comprising:

adding a weight on the mounting plate while driving the probe into the ground and wobbling the probe.

17. The method for forming the hole in the ground as claimed in claim 13, further comprising:

mounting a sleeve around the probe before driving the probe into the ground; and leaving the sleeve in the ground after moving the probe upward from the ground along the vertical axis.

18. The method for forming the hole in the ground as claimed in claim 17, further comprising:

vibrating the probe along the vertical axis while driving the probe into the ground and wobbling the probe.

19. The method for forming the hole in the ground as claimed in claim 18, with driving the probe into ground along the vertical axis including moving a mounting plate of a loader downward, with the probe being mounted on the mounting plate, with wobbling the probe also wobbling the sleeve and including moving two cylinders in a same direction at a same rate or at different rates or moving the two cylinders in different directions, with each of the two cylinders being movable between an extended position and a retracted position, with each of the two cylinders including an upper end interconnected to the mounting plate by a first universal joint and a lower end coupled to the probe by a second universal joint.

20. The method for forming the hole in the ground as claimed in claim 13, with driving the probe into the ground along the vertical axis including moving a mounting plate of a loader downward, with the probe being mounted on the mounting plate, with wobbling the probe comprising providing the probe further including an upper end spaced from the bottom end along the vertical axis, with the probe including an upper section having the upper end, a lower section having the bottom end, and an intermediate section between the upper and lower sections, with the intermediate section being coupled to the upper section by a first universal joint, with the intermediate section being coupled to the lower section by a second universal joint, with the upper end fixed to the mounting plate, and with wobbling the probe comprising moving the intermediate section relative to the mounting plate.

* * * * *